US011362460B2

(12) United States Patent
Kitagawa et al.

(10) Patent No.: US 11,362,460 B2
(45) Date of Patent: Jun. 14, 2022

(54) CONNECTOR

(71) Applicant: YAZAKI CORPORATION, Tokyo (JP)

(72) Inventors: Hiroki Kitagawa, Kakegawa (JP); Yasuhiro Tanaka, Kakegawa (JP); Masanobu Higashitani, Kakegawa (JP); Yusuke Tsutagawa, Kakegawa (JP); Masatoshi Yamada, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/193,622

(22) Filed: Mar. 5, 2021

(65) Prior Publication Data

US 2021/0288436 A1 Sep. 16, 2021

(30) Foreign Application Priority Data

Mar. 16, 2020 (JP) ..... JP2020-045707

(51) Int. Cl.

| | |
|---|---|
| ***H01R 13/56*** | (2006.01) |
| ***H01R 4/18*** | (2006.01) |
| ***H01R 4/20*** | (2006.01) |

(52) U.S. Cl.
CPC ..... *H01R 13/562* (2013.01); *H01R 4/182* (2013.01); *H01R 4/20* (2013.01); *H01R 2201/26* (2013.01)

(58) Field of Classification Search
CPC .... H01R 13/562; H01R 4/20; H01R 2201/26; H01R 4/182
See application file for complete search history.

(56) References Cited

U.S. PATENT DOCUMENTS

| | | | | |
|---|---|---|---|---|
| 9,653,843 | B2 * | 5/2017 | Suzuki | H01R 13/58 |
| 2012/0015546 | A1 | 1/2012 | Yamaguchi et al. | |
| 2016/0276776 | A1 | 9/2016 | Motohashi et al. | |

FOREIGN PATENT DOCUMENTS

| | | | |
|---|---|---|---|
| JP | 2011-14422 | A | 1/2011 |
| JP | 2016-173967 | A | 9/2016 |

* cited by examiner

*Primary Examiner* — Briggitte R. Hammond
(74) *Attorney, Agent, or Firm* — Sughrue Mion, PLLC

(57) ABSTRACT

There is provided a connector including: a housing; and a terminal-equipped electric wire assembled to the housing. The terminal-equipped electric wire includes: a terminal; an electric wire; and a flexible conductor provided between the terminal and the electric wire. The flexible conductor is divided into a plurality of divided conductor portions along an axial direction of the flexible conductor. The divided conductor portions are bent in different directions from each other.

8 Claims, 6 Drawing Sheets

CONNECTOR

CROSS-REFERENCE TO RELATED APPLICATIONS

This application is based on and claims priority under 35 USC 119 from Japanese Patent Application No. 2020-045707 filed on Mar. 16, 2020, the contents of which are incorporated herein by reference.

TECHNICAL FIELD

The present disclosure relates to a connector.

BACKGROUND ART

JP2016-173967A explains a structure of a connector in which a flexible conductor is interposed between a terminal and an electric wire, a force generated in the electric wire is absorbed by the flexible conductor, and transmission of the force from the electric wire to the terminal is prevented. JP2016-173967A also explains that the flexible conductor is formed with a bending portion to improve the effect of preventing the transmission of the force from the electric wire to the terminal.

A flexible conductor having a large electrical conduction area is used in a connector used for a power supply line for supplying power. In this case, it is difficult to bend the flexible conductor and the effect of preventing the transmission of a force from the electric wire to the terminal is reduced. Therefore, a contact load between the terminal and a counterpart terminal must be increased considering a reaction force from the electric wire.

However, when the contact load between the terminal and the counterpart terminal is increased, an insertion force required for connection with a counterpart connector is increased, and connection workability is reduced.

SUMMARY OF INVENTION

The present disclosure provides a connector capable of obtaining a good effect of preventing transmission of a force between an electric wire and a terminal while reducing an insertion force required for connection with a counterpart connector.

According to an aspect of the present disclosure, a connector includes: a housing; and a terminal-equipped electric wire assembled to the housing. The terminal-equipped electric wire includes: a terminal; an electric wire; and a flexible conductor provided between the terminal and the electric wire. The flexible conductor is divided into a plurality of divided conductor portions along an axial direction of the flexible conductor. The divided conductor portions are bent in different directions from each other.

The present disclosure has been briefly described above. Further, details of the present disclosure will be clarified by reading an aspect (hereinafter, referred to as an "embodiment") for implementing the disclosure to be described below with reference to the accompanying drawings.

DESCRIPTION OF EMBODIMENTS

Hereinafter, an embodiment of the present disclosure will be described with reference to the drawings.

Figure 1:
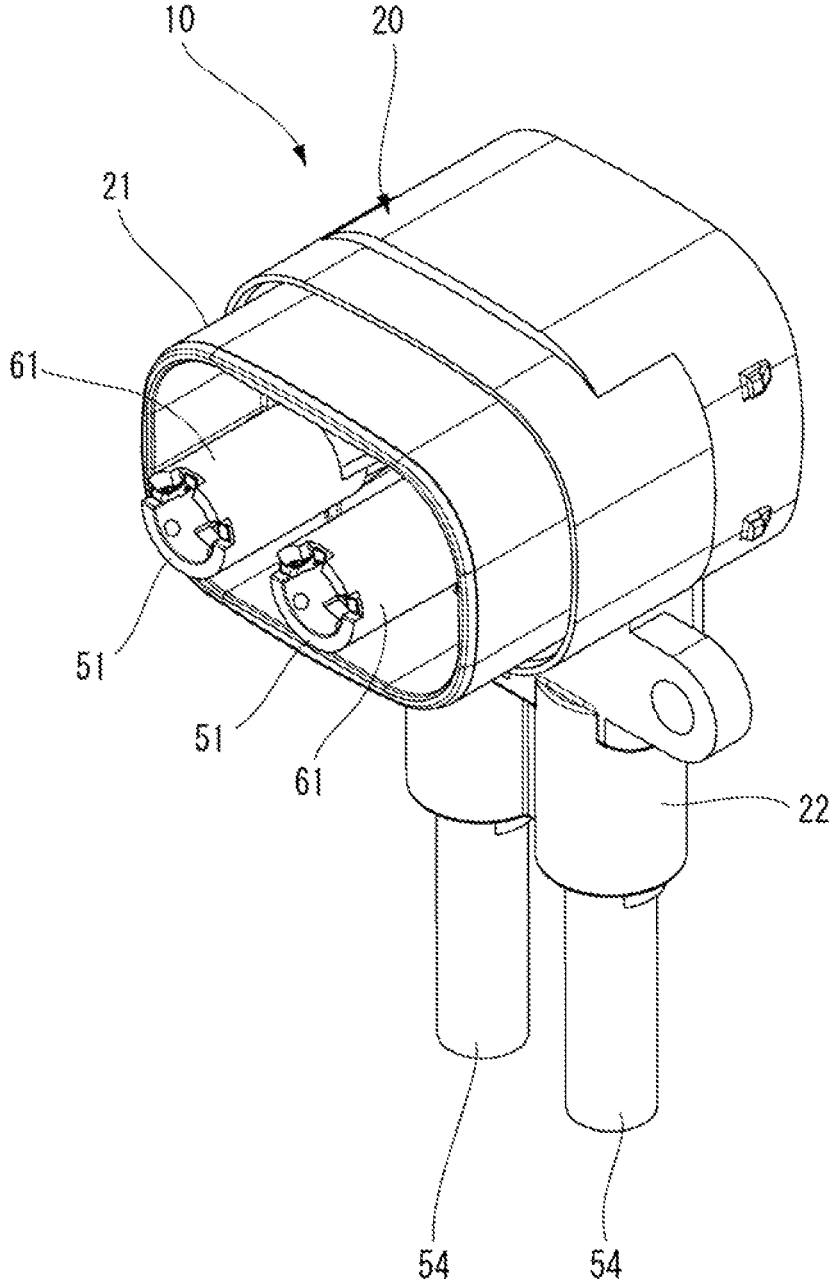
FIG. 1 is a perspective view showing a connector according to an embodiment.
Figure 2:
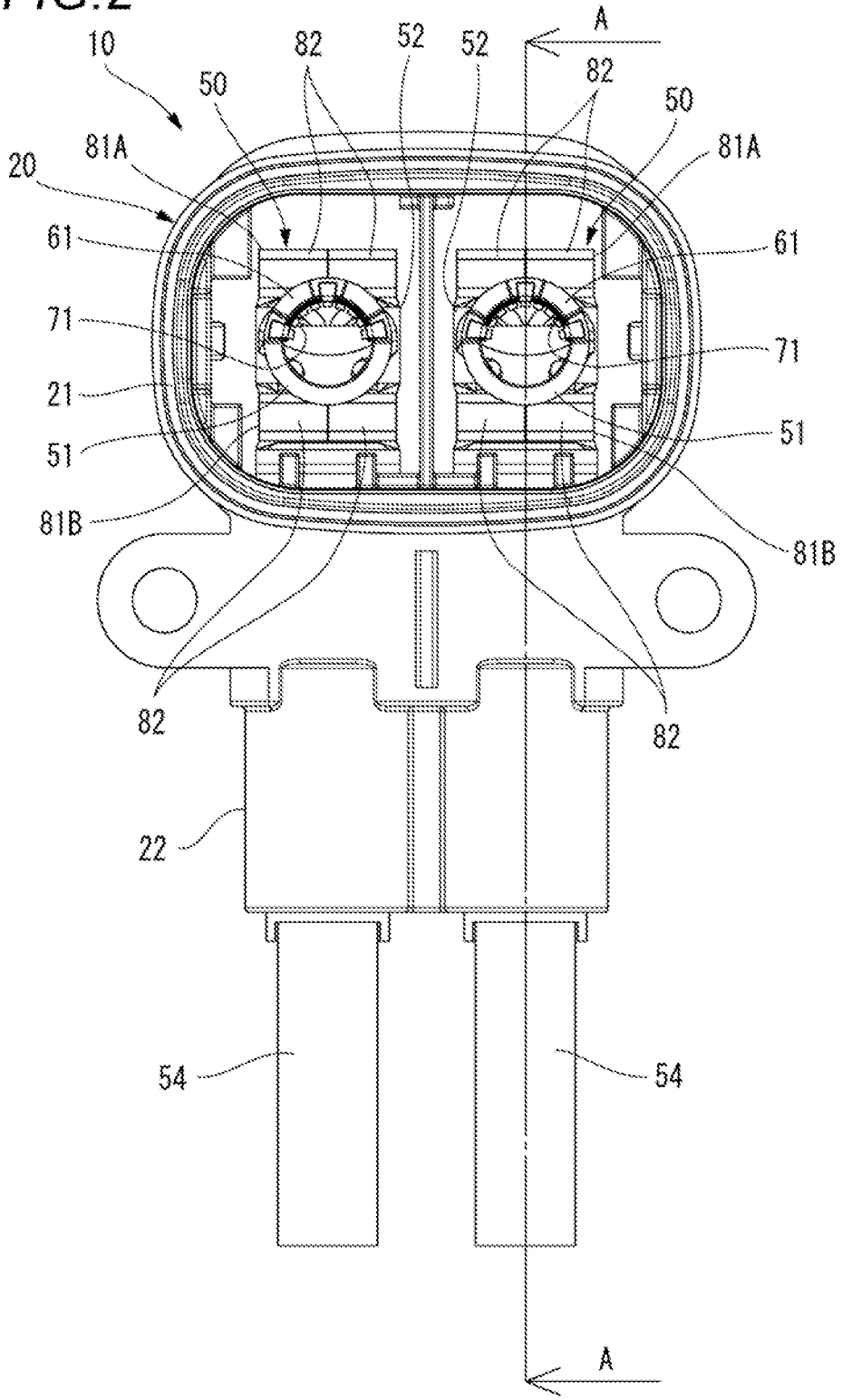
FIG. 2 is a front view showing the connector according to the embodiment.
Figure 3:
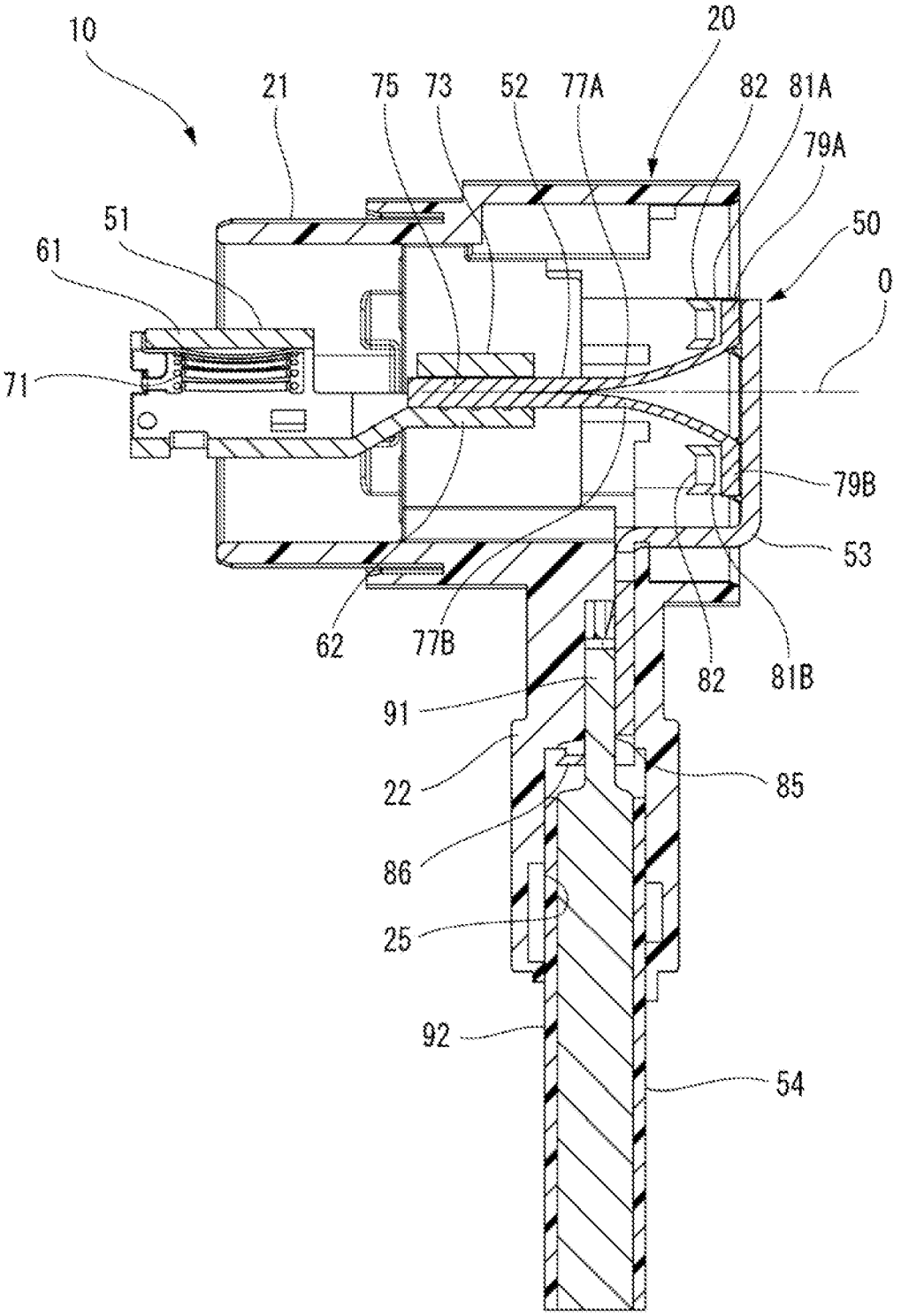
FIG. 3 is a cross-sectional view taken along a line A-A in FIG. 2.

FIG. 1 is a perspective view showing a connector according to the embodiment. FIG. 2 is a front view showing the connector according to the embodiment. FIG. 3 is a cross-sectional view taken along a line A-A in FIG. 2.

As shown in FIGS. 1 to 3, a connector 10 according to the present embodiment includes a housing 20 and two terminal-equipped electric wires 50. The connector 10 is, for example, a connector used in a power supply circuit such as an inverter or a motor of a vehicle such as a hybrid vehicle or an electric vehicle. A periphery of the connector 10 is covered with a shield case (not shown).

The housing 20 includes a hood portion 21 and an electric wire introduction portion 22. The hood portion 21 is formed into a tubular shape and protrudes toward a front side of the housing 20. A front holder (not shown) is assembled to the hood portion 21 from a front side.

The electric wire introduction portion 22 is provided near a rear end of the housing 20 and extends downward in a direction orthogonal to a front-rear direction of the housing 20. The electric wire introduction portion 22 is formed with an electric wire through hole 25.

Figure 4:
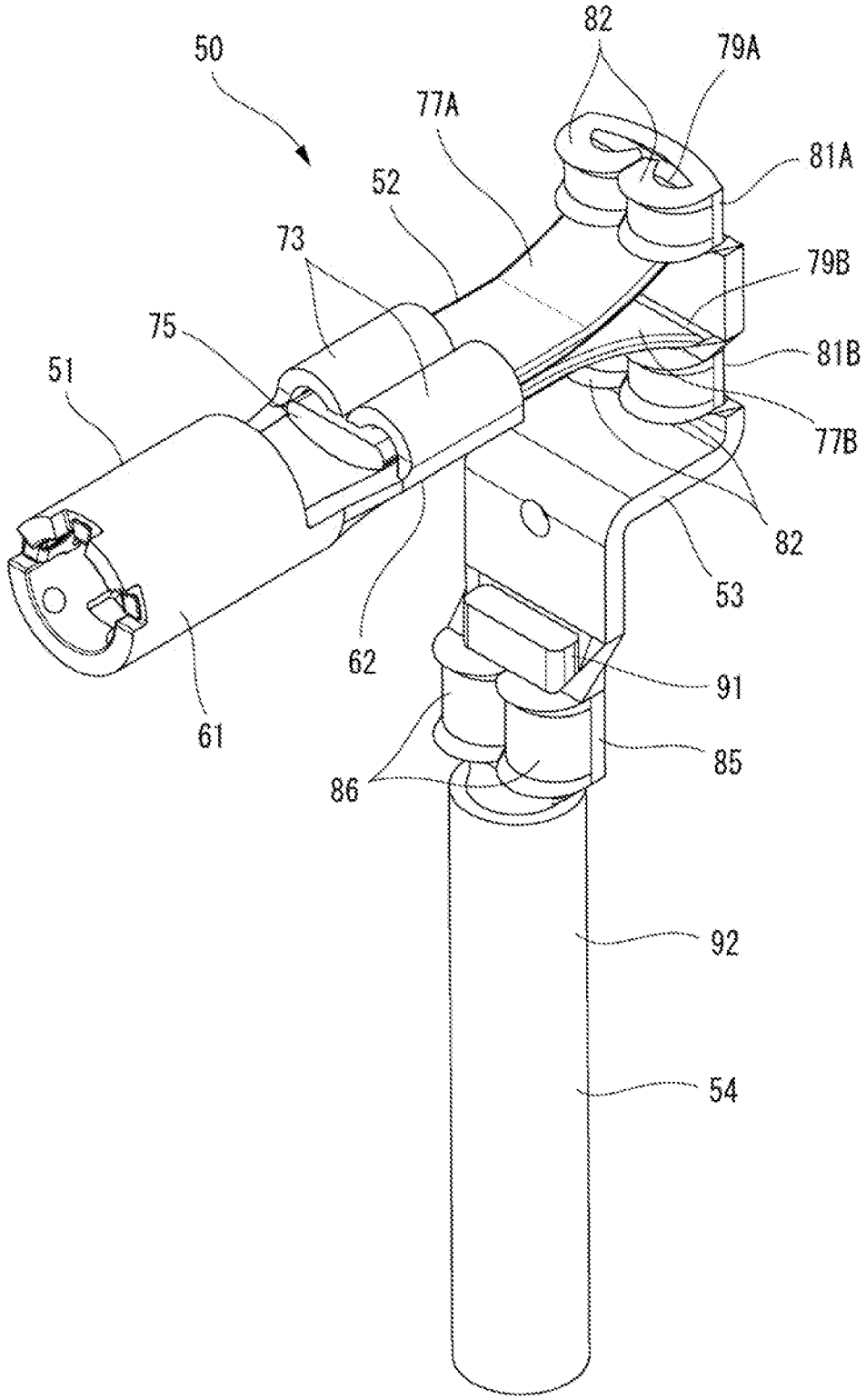
FIG. 4 is a perspective view showing a terminal-equipped electric wire to be assembled to a housing as viewed from a front side.
Figure 5:
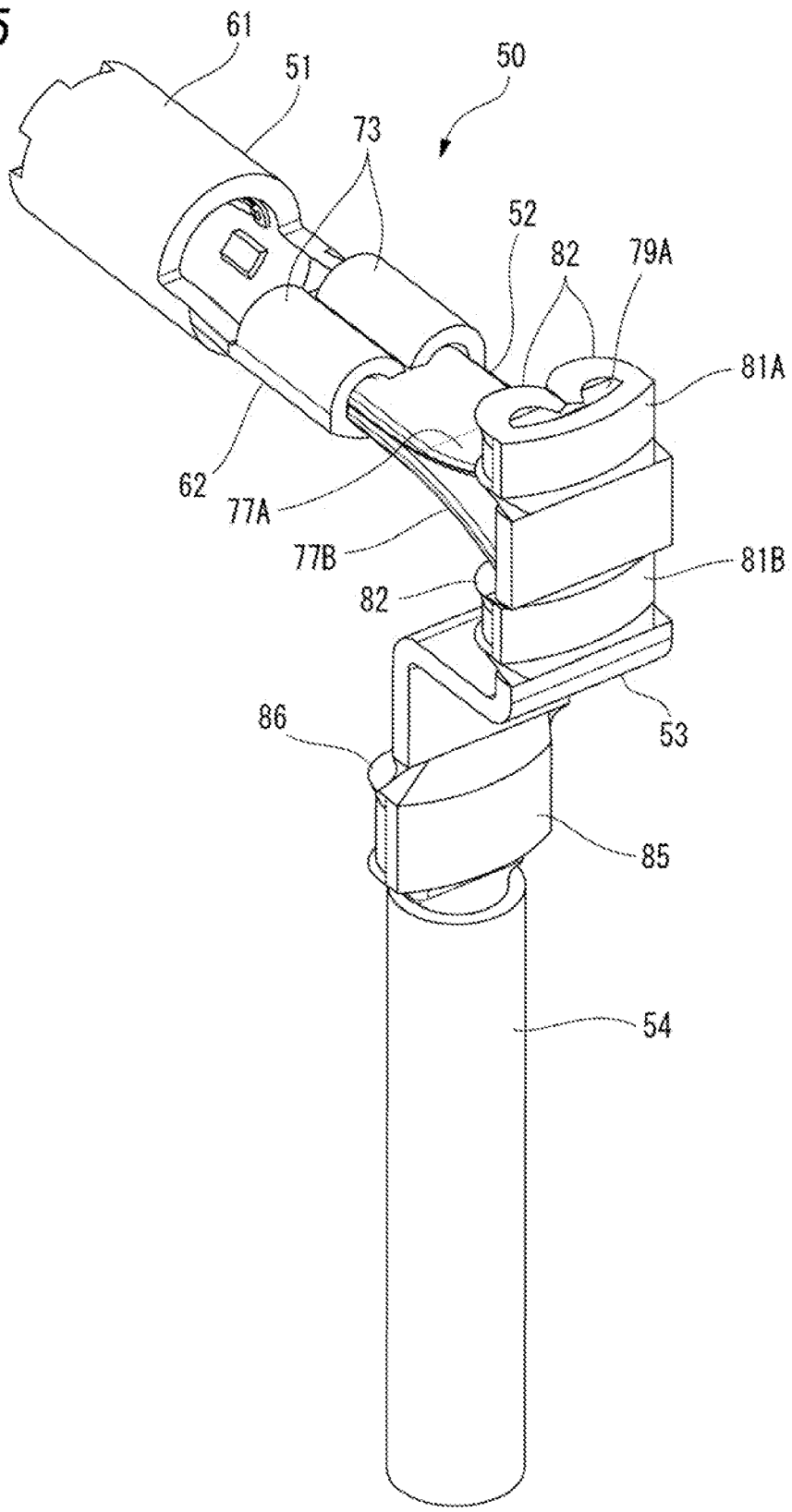
FIG. 5 is a perspective view showing the terminal-equipped electric wire to be assembled to the housing as viewed from a rear side.

FIG. 4 is a perspective view showing a terminal-equipped electric wire to be assembled to the housing as viewed from a front side. FIG. 5 is a perspective view showing the terminal-equipped electric wire to be assembled to the housing as viewed from a rear side.

As shown in FIGS. 4 and 5, the terminal-equipped electric wire 50 includes a terminal 51, a flexible conductor 52, a busbar 53, and an electric wire 54.

The terminal 51 is formed of a conductive metal material such as copper, a copper alloy, aluminum, and an aluminum alloy. The terminal 51 includes an electrical connection portion 61 and a crimping portion 62.

The electrical connection portion 61 is formed into a tubular shape, and a spring contact 71 having a semi-annular shape is provided inside the electrical connection portion 61. A connection pin of a counterpart terminal (not shown) provided in a counterpart connector (not shown) is inserted into the electrical connection portion 61. Then, the semi-annular spring contact 71 comes into contact with an outer peripheral surface of the connection pin, and presses the connection pin against an inner peripheral surface of the electrical connection portion 61. Accordingly, the terminal 51 and the counterpart terminal are electrically connected to each other.

The crimping portion 62 has a pair of crimping pieces 73, and the crimping portion 62 is crimped to a connection end 75 that is one end of the flexible conductor 52 by the crimping pieces 73. Accordingly, the flexible conductor 52 is connected to the terminal 51.

The flexible conductor 52 is, for example, a conductor formed of a braid in which a plurality of strands are braided. One end of the flexible conductor 52 is the connection end 75 to be crimped to the crimping portion 62 of the terminal 51. The flexible conductor 52 is divided into two divided conductor portions 77A and 77B from the connection end 75 toward the other end. The divided conductor portions 77A and 77B are divided in an upper-lower manner and extend rearward in a state of overlapping with each other. Rear ends of the divided conductor portions 77A and 77B at an opposite side to the connection end 75 respectively serve as fixed ends 79A and 79B.

The divided conductor portions 77A and 77B are evenly arranged around a central axis O of the flexible conductor 52, and are bent in directions away from the central axis O of the flexible conductor 52. Two divided conductor portions 77A and 77B are provided in this example. The divided conductor portions 77A and 77B are disposed at opposite positions sandwiching the central axis O of the flexible conductor 52, and are bent in opposite directions toward the fixed ends 79A and 79B at the rear ends.

The busbar 53 is formed of a conductive metal material such as copper, a copper alloy, aluminum, and an aluminum alloy. The busbar 53 has two coupling crimping portions 81A and 81B at one end side and an electric wire crimping portion 85 at the other end side.

Each of the coupling crimping portions 81A and 81B has a pair of crimping pieces 82, and the electric wire crimping portion 85 has a pair of crimping pieces 86. The coupling crimping portion 81A is crimped to the fixed end 79A of the divided conductor portion 77A of the flexible conductor 52 by the crimping pieces 82. The coupling crimping portion 81B is crimped to the fixed end 79B of the divided conductor portion 77B of the flexible conductor 52 by the crimping pieces 82. Accordingly, the divided conductor portions 77A and 77B of the flexible conductor 52 are connected to the busbar 53.

The electric wire 54 is an insulated electric wire of which an outer periphery of a conductor 91 is covered with an outer sheath 92. An end portion of the conductor 91 is exposed from the outer sheath 92. The electric wire crimping portion 85 of the busbar 53 is crimped to the conductor 91 of the electric wire 54 by the crimping pieces 86. Accordingly, the electric wire 54 is connected to the busbar 53.

The two terminal-equipped electric wires 50 each including the terminal 51, the flexible conductor 52, the busbar 53, and the electric wire 54 are assembled to the housing 20. Accordingly, the electric wire 54 of the terminal-equipped electric wire 50 passes through and is held in the electric wire through hole 25 of the electric wire introduction portion 22, and the terminal 51, the flexible conductor 52, and the busbar 53 are accommodated in the housing 20. The terminal 51 of each terminal-equipped electric wire 50 is disposed in the hood portion 21 of the housing 20 and is held by the front holder assembled to the hood portion 21 from a front side.

A hood portion 21 side of the connector 10 having the above configurations is fitted to a counterpart connector. Accordingly, a connection pin of a counterpart terminal is inserted and connected to the electrical connection portion 61 of the terminal 51 in the hood portion 21.

When vibration is applied to the connector 10 during traveling of a vehicle or the like, the vibration is transmitted to the electric wire 54 as an external force. At this time, the external force from the electric wire 54 is absorbed by the flexible conductor 52, and transmission of the external force to the terminal 51 is prevented in the connector 10 according to the present embodiment.

At this time, even when the number of the flexible conductors 52 is one, the effect of preventing the transmission of the external force from the electric wire 54 to the terminal 51 can be obtained. However, when the connector 10 is provided with the electric wire 54, such as a power line, through which a large current flows, the flexible conductor 52 becomes thick, flexibility is reduced, and the effect of preventing the transmission of the external force from the electric wire 54 to the terminal 51 is reduced. One flexible conductor 52 is bent to one side when absorbing the external force by bending. Therefore, when the number of the flexible conductors 52 is one, a reaction force generated in a direction opposite to a bending direction of bending the flexible conductor 52 is applied to the terminal 51. A twist may occur at a connection portion between the terminal 51 and a counterpart terminal.

In contrast, according to the connector 10 in the present embodiment, the external force from the electric wire 54 can be distributed and absorbed by the divided conductor portions 77A and 77B. Accordingly, the effect of preventing the transmission of the external force from the electric wire 54 can be improved as compared with a case where one flexible conductor is provided at the same cross section.

Since the divided conductor portions 77A and 77B are bent in different directions, reaction forces generated in directions opposite to respective bending directions when the divided conductor portions 77A and 77B absorb the external force are balanced. Accordingly, transmission of a bending force to the terminal 51 can also be prevented.

In particular, the divided conductor portions 77A and 77B are evenly arranged around the central axis O of the flexible conductor 52, and the bending directions of the divided conductor portions 77A and 77B are directions away from the central axis O of the flexible conductor 52, so that reaction forces generated in directions opposite to the bending directions when the divided conductor portions 77A and 77B absorb the external force are balanced.

Therefore, there is no need to increase a contact load between the terminal 51 and the counterpart terminal considering the reaction force from the electric wire 54, so that an insertion force required for connection with a counterpart connector can be reduced and connection workability can be improved.

Since the divided conductor portions 77A and 77B are connected to the electric wire 54 via the busbar 53, the external force from the electric wire 54 can also be absorbed by the busbar 53, and the effect of preventing the transmission of the external force from the electric wire 54 to the terminal 51 can be improved.

Next, a connector according to a modification will be described.

The same components as those in the above-described embodiment are denoted by the same reference numerals, and a description thereof will be omitted.

Figure 6:
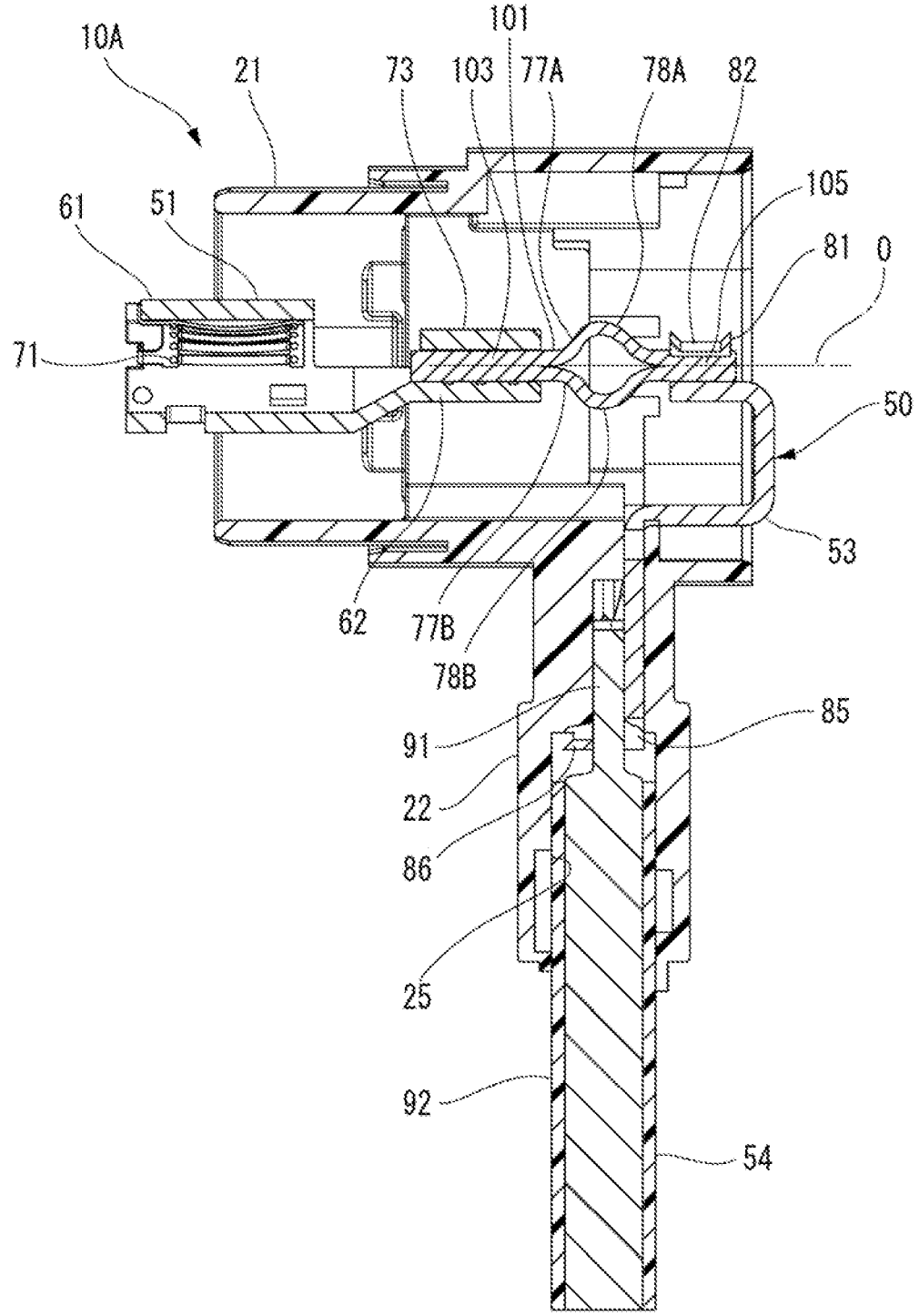
FIG. 6 is a cross-sectional view showing a connector according to a modification and corresponding to an A-A cross section in FIG. 2.

FIG. 6 is a cross-sectional view showing a connector according to a modification and corresponding to an A-A cross section in FIG. 2.

As shown in FIG. 6, a connector 10A according to the modification includes a flexible conductor 101 that is divided into two divided conductor portions 77A and 77B at an intermediate portion in a longitudinal direction. A front end of the flexible conductor 101 is a connection end 103 and a rear end of the flexible conductor 101 is a fixed end 105. The connection end 103 of the flexible conductor 101 is crimped to the crimping portion 62 of the terminal 51 and is connected to the terminal 51. The fixed end 105 of the flexible conductor 101 is connected to the busbar 53. The busbar 53 is provided with one coupling crimping portion 81 having a pair of crimping pieces 82. The coupling crimping portion 81 is crimped to the fixed end 105 of the flexible conductor 101 by the crimping pieces 82.

The divided conductor portions 77A and 77B of the flexible conductor 101 have excess length portions 78A and 78B that are bent in directions spaced apart from the central axis O of the flexible conductor 101. More specifically, the excess length portions 78A and 78B may be bent in the directions spaced apart from the central axis O and bent in directions getting close to the central axis O between the connection end 103 and the fixed end 105.

According to the connector 10A in the modification, since the divided conductor portions 77A and 77B have the excess length portions 78A and 78B that are bent in directions spaced apart from the central axis O of the flexible conductor 52, an external force from the electric wire 54 can be absorbed by the excess length portions 78A and 78B of the divided conductor portions 77A and 77B, and the effect of preventing the transmission of the external force from the electric wire 54 can be further improved.

Although the flexible conductor 52, 101 having two divided conductor portions 77A and 77B is provided in the embodiment and the modification described above, the number of the divided conductor portions may be three or more.

Although the flexible conductor 52, 101 formed of a braid is used in the embodiment and the modification described above, the flexible conductor 52, 101 is not limited to the braid, and may be a stranded wire or a flexible printed wiring board.

The present disclosure is not limited to the above-described embodiment, and may be appropriately modified, improved, and the like. In addition, materials, shapes, dimensions, numbers, arrangement positions, and the like of components in the above-described embodiments are optional and are not limited as long as the present disclosure can be achieved.

According to a first aspect of the present disclosure, a connector (10, 10A) includes: a housing (20); and a terminal-equipped electric wire (50) assembled to the housing (20). The terminal-equipped electric wire (50) includes: a terminal (51); an electric wire (54); and a flexible conductor (52) provided between the terminal (51) and the electric wire (54). The flexible conductor (52) is divided into a plurality of divided conductor portions (77A, 77B) along an axial direction of the flexible conductor (52). The divided conductor portions (77A, 77B) are bent in different directions from each other.

According to the connector of the first aspect, an external force from the electric wire can be distributed and absorbed by the divided conductor portions. Accordingly, the effect of preventing transmission of the external force from the electric wire can be improved as compared with a case where one flexible conductor is provided at the same cross section.

Since the divided conductor portions are bent in different directions, reaction forces generated in directions opposite to respective bending directions when the divided conductor portions absorb the external force are balanced. Accordingly, transmission of a bending force to the terminal can also be prevented.

Therefore, there is no need to increase a contact load between the terminal and a counterpart terminal considering the reaction force from the electric wire, so that an insertion force required for connection with a counterpart connector can be reduced and connection workability can be improved.

According to a second aspect of the present disclosure, the divided conductor portions (77A, 77B) are evenly arranged from a central axis (0) of the flexible conductor (52), the divided conductor portions (77A, 77B) being respectively bent in directions away from the central axis (0).

According to the connector of the second aspect, the divided conductor portions are evenly arranged around the central axis O of the flexible conductor, and bending directions of the divided conductor portions are directions away from the central axis O of the flexible conductor, so that reaction forces generated in directions opposite to the bending directions when the divided conductor portions absorb the external force are balanced. Accordingly, transmission of a bending force to the terminal can be more effectively prevented.

According to a third aspect of the present disclosure, each of the divided conductor portions (77A, 77B) has an excess length portion (78A, 78B) bent in a direction spaced apart from a central axis (0) of the flexible conductor (52).

According to the connector of the third aspect, the external force from the electric wire can be absorbed by the excess length portions of the divided conductor portions, and the effect of preventing the transmission of the external force from the electric wire can be further improved.

According to a fourth aspect of the present disclosure, the connector (10, 10A) further includes a busbar (53). The divided conductor portions (77A, 77B) are connected to the electric wire (54) via the busbar (53).

According to the connector of the fourth aspect, the external force from the electric wire can also be absorbed by the busbar, and the effect of preventing transmission of the external force from the electric wire to the terminal can be improved.

According to the present disclosure, it is possible to provide the connector capable of obtaining a good effect of preventing transmission of a force between an electric wire and a terminal while reducing an insertion force required for connection with a counterpart connector.

What is claimed is:

1. A connector comprising:
- a housing; and
- a terminal-equipped electric wire assembled to the housing,
- wherein the terminal-equipped electric wire includes:
  - a terminal;
  - an electric wire; and
  - a flexible conductor provided between the terminal and the electric wire,
- wherein the flexible conductor is divided into a plurality of divided conductor portions along an axial direction of the flexible conductor in a state of overlapping with each other in an upper-lower manner, and
- wherein the divided conductor portions are bent in different directions from each other.

2. The connector according to claim 1, wherein the divided conductor portions are evenly arranged from a central axis of the flexible conductor, the divided conductor portions being respectively bent in directions away from the central axis.

3. The connector according to claim 1, wherein each of the divided conductor portions has an excess length portion bent in a direction spaced apart from a central axis of the flexible conductor.

4. The connector according to claim 1, further comprising a busbar, wherein the divided conductor portions are connected to the electric wire via the busbar.

5. The connector according to claim 1, wherein the divided conductor portions are bent in opposite directions from each other.

6. The connector according to claim 1, wherein the housing includes an electric wire introduction portion extending downward in a direction orthogonal to a front-rear direction of the housing, and holding the electric wire.

7. The connector according to claim 1, wherein the electric wire is provided to extend in a direction orthogonal to the extending direction of the terminal.

8. The connector according to claim 1, wherein the flexible conductor is formed of a braid in which a plurality of strands are braided.

* * * * *